United States Patent [19]

Griffiths

[11] 4,231,615

[45] Nov. 4, 1980

[54] SEAT FRAMES

[75] Inventor: David T. Griffiths, Pontardulais, Wales

[73] Assignee: Youngflex S.A., Fribourg, Switzerland

[21] Appl. No.: 964,987

[22] Filed: Nov. 30, 1978

Related U.S. Application Data

[60] Continuation of Ser. No. 818,505, Jul. 25, 1977, abandoned, which is a division of Ser. No. 604,177, Aug. 13, 1975, Pat. No. 4,050,738, which is a continuation-in-part of Ser. No. 440,782, Feb. 8, 1974, abandoned.

[30] Foreign Application Priority Data

Feb. 16, 1973 [GB] United Kingdom ..... 7874/73

[51] Int. Cl.[2] ..... A47C 7/35

[52] U.S. Cl. ..... 297/452; 5/247; 5/255; 267/143; 297/458

[58] Field of Search ..... 297/452, 455, 456, 458–460; 267/103, 106, 142, 143; 248/373, 387; 5/247, 255, 260

[56] References Cited

U.S. PATENT DOCUMENTS

| | | | |
|---|---|---|---|
| 2,925,855 | 2/1960 | Caughey | 267/142 |
| 3,024,016 | 3/1962 | Strout et al. | 267/142 |
| 3,039,763 | 6/1962 | Staples et al. | 297/456 X |
| 3,248,745 | 5/1966 | Gunlock | 5/255 X |
| 3,610,688 | 10/1971 | Arnold et al. | 297/452 |
| 3,639,002 | 2/1972 | Tischler | 297/452 |
| 3,727,980 | 4/1973 | Tischler | 297/452 |
| 3,797,886 | 3/1974 | Griffiths | 297/452 |

FOREIGN PATENT DOCUMENTS

| | | | |
|---|---|---|---|
| 934203 | 8/1963 | United Kingdom | 297/458 |
| 1053768 | 1/1967 | United Kingdom | 297/456 |
| 1153060 | 5/1969 | United Kingdom | 297/452 |

*Primary Examiner*—William E. Lyddane

*Attorney, Agent, or Firm*—Berman, Aisenberg & Platt

[57] ABSTRACT

A frame for an automobile seat or a domestic seat comprises a base frame; a pad which consists of a series of parallel cords and a series of parallel cross-wires, and is suspended over the base frame; spring elements having torsion parts secured to the cords of the pad; and an edge frame mounted above the base frame on limbs of said spring elements which extend upwardly and outwardly from the side edge regions of the pad and are secured at their upper ends to said edge frame. The spring elements have lengths which may be anchored on said pad or on said base frame, and spring elements of both forms may be employed.

4 Claims, 8 Drawing Figures

SEAT FRAMES

CROSS-REFERENCE TO RELATED APPLICATIONS

The present application is a continuation of application Ser. No. 818,505 filed July 25, 1977, now abandoned, which in turn is a division of application Ser. No. 604,177 filed Aug. 13, 1975, now U.S. Pat. No. 4,050,738, which in turn is a continuation in part, of Ser. No. 440,782, filed Feb. 8, 1974, now abandoned.

BACKGROUND OF THE INVENTION

The invention relates in particular to vehicle seat frames, and is an improvement in or a modification of the invention described in my earlier U.S. Pat. No. 3,797,886.

In my said U.S. Pat. No. 3,797,886 the seat frame comprises a base frame, a pad suspended across the base frame by means of two rows of tension spring members which extend from opposite sides of the base frame for connection with the corresponding side edges of the pad, and an edge frame mounted above the base frame on jack spring members which extend upwardly and outwardly from the side edge regions of the pad and are secured at their upper ends to said edge frame.

The object of the present invention is, again, to provide a seat frame which has a sprung edge of improved form and which may be covered by a plastics sheet or the like without the necessity of providing a shaped foam-plastic or latex moulding.

SUMMARY OF THE INVENTION

According to the present invention, the edge frame is mounted above the base frame on spring elements which comprise a torsion part secured to said pad, a length extending laterally from one end of the torsion part and anchored, and a limb extending laterally and upwardly from said torsion part and secured at its upper end to said edge frame.

The anchored length may be anchored on the pad or on the base frame. In the former case, the spring element may extend across the frame and comprise a central length, a torsion part at each end of the central length, and a limb extending upwardly from each torsion part. In the latter case, the spring element may have the general form of a jack spring.

In the present invention, the spring elements and pad may form a separate unit which can be stacked and transported and, in further accordance with the present invention, there is provided a cushion frame for a seat, comprising a pad formed as a series of parallel cord lengths and a series of cross wires, and an edge frame mounted generally above the pad on spring elements which are secured to said cord lengths and extend upwardly from the side edge regions of the pad and are secured at their upper ends to their edge frame.

It will be appreciated that, if desired, combinations of the spring elements and the various forms of the aforementioned jack springs may be employed in any particular seat structure.

Other objects and advantages of the present invention will become apparent from the following description of preferred embodiments.

DESCRIPTION OF THE PREFERRED EMBODIMENTS

Figure 1:
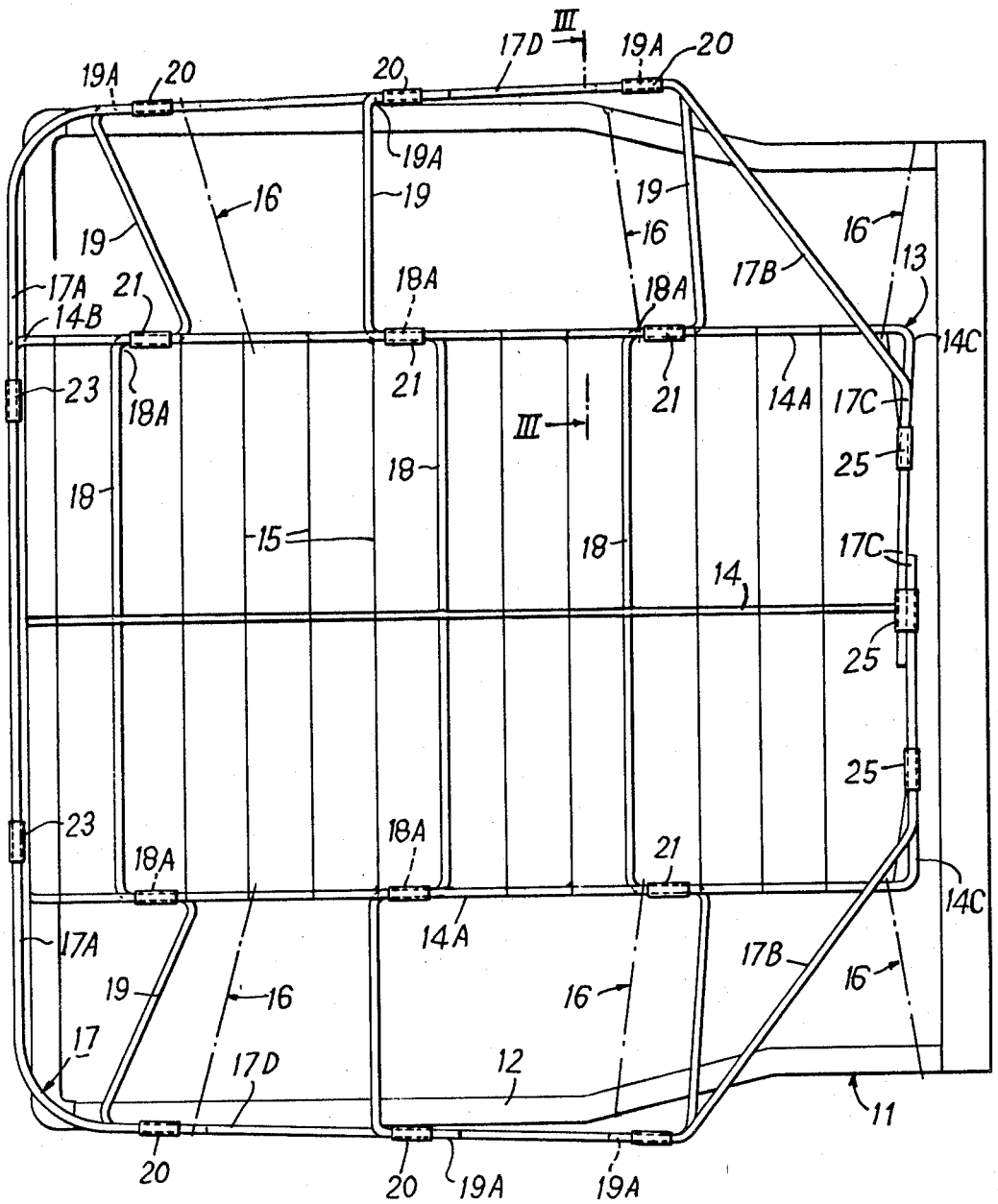
FIG. 1 is a plan view showing one form of vehicle seat frame according to the present invention.
Figure 2:
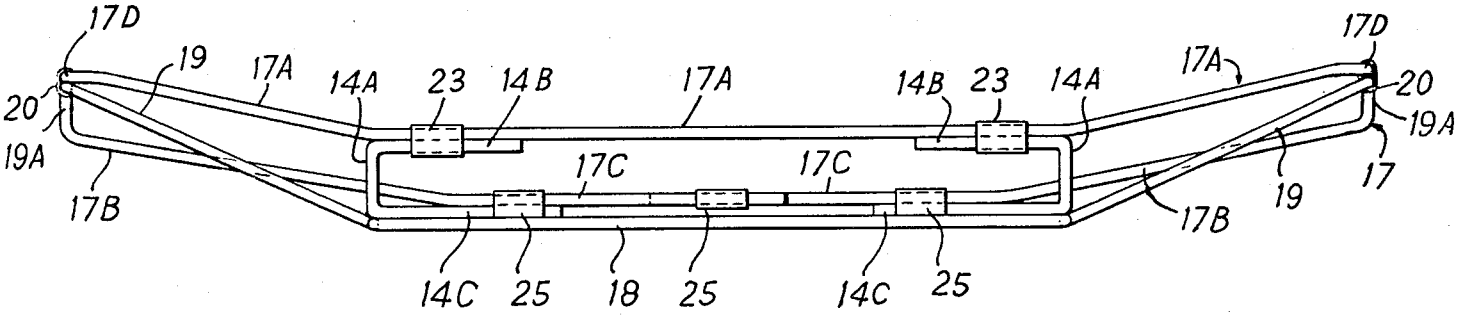
FIG. 2 is a front end view showing part of the frame illustrated in FIG. 1.
Figure 3:
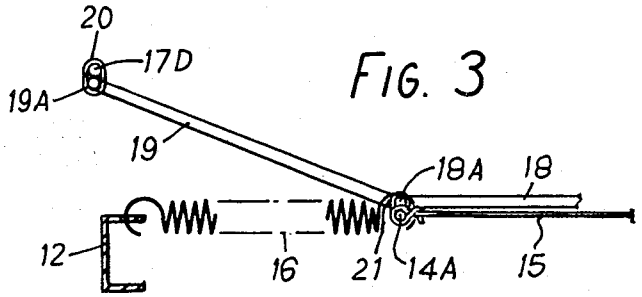
FIG. 3 is a detail section on the line III—III of FIG. 1.

Referring to FIGS. 1 to 3 of the drawings, the seat frame comprises a metal base frame 11 having lateral side lengths 12. A pad 13 comprises a series of paper cords of which the outermost cords 14A are wire cored, and cross-wires 15 which penetrate the optional middle cord 14 and are locked around the cords 14A. The pad 13 is suspended across the base frame by two rows of helical tension springs indicated at 16 and provided with hooked ends which are anchored in the side lengths 12 and with similar ends which hook round the cords 14A.

According to the present invention, a top edge frame 17 formed of resilient wire extends above the base frame and is carried by three spring elements 18 which have upwardly extending limbs 19. The spring elements 18 comprise formed-wire springs, and end lengths 19A of the limbs are clamped to the edge frame 17 by clips 20. Likewise, short parts 18A of the spring elements are clamped to the cords 14A of the pad 13 by clips 21.

To minimize noise during use of the seat, the spring elements 18 may be paper-wrapped or have plastics or like coatings. The elements 18, and also the frame 17, may comprise wire-cored cords such as cords 14A.

The front length 17A of the edge frame 17 is clamped to inturned front ends 14B of the cords 14A by metal clips 23 which may also embrace the foremost of the cross wires 15. The rearward lengths 17B of the edge frame 17 are angled inwardly and the rear lengths 17C are likewise clamped to inturned rear ends 14C of the cords 14A by clips 25 which also embrace the rearmost of the cross wires 15. As can be seen from FIG. 2, the front end of the pad 13 is upwardly inclined to meet the front length 17A, and side lengths 17D of the edge frame 17 slope gently upwards towards the front.

In the embodiment illustrated in FIGS. 1 to 3, the rear lengths 17C overlap one another and the edge frame 17 is continuous; however, at either the front or the rear, the cord ends may be extended to overlap one another in which case the frame 17 may have two short front or rear lengths (17A or 17C). In any case, the edge frame (17) should be effectively continuous and the pad 13 should have an effectively continuous peripheral cord (14A).

The structure described above thus provides a seat frame which can be covered simply by foam plastic or a latex pad of uniform thickness and then by cover trim, to provide sprung edges which exhibit highly satisfactory characteristics for use in a vehicle such as a motor car. The flexibility of the sprung edge results largely from the parts 18A acting as torsion springs, and also from the cantilever spring effect derived from the limbs 19. The depth and other dimensions of the seats can be selected by suitably arranging and dimensioning the spring elements 18 which can be varied in number and form; the form of the elements 18 and the material from which they are produced can be chosen to provide the seat with its required characteristics such as of strength and resilience.

It will be appreciated that, as opposed to the constructions disclosed in the specification of my said U.S. Pat. No. 3,797,886 the above cushion frame, i.e. the assembly of the pad 13 and the spring elements 18, is a separate unit which can conveniently be stacked and transported. Furthermore, no additional openings in the side lengths 12 of the frame need be provided to receive the ends of edge support members such as the jack springs 18 illustrated in my earlier application. A further attraction of the present invention is that the above-mentioned unit may be moulded with a capsule of, for example, polyurethene.

The frames may also be used in, for example, domestic furniture and the same or similar structures may also be incorporated in seat backs.

Figure 4:
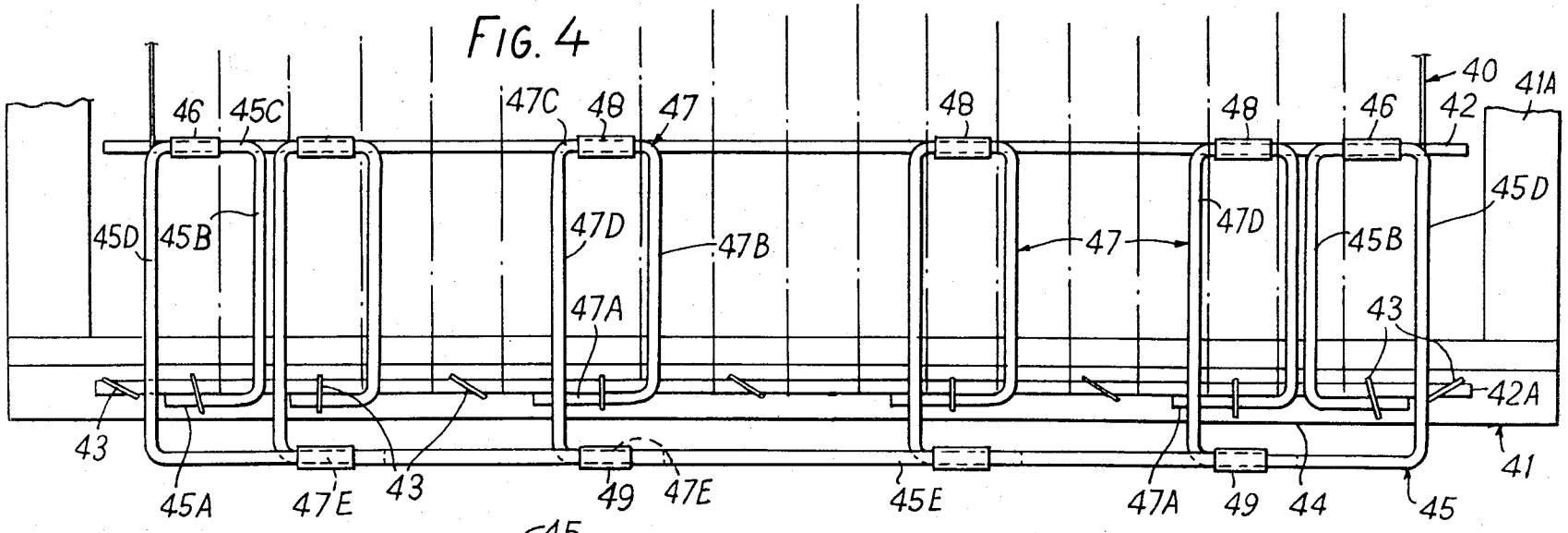
FIG. 4 is a fragmentary plan view showing a frame for an upholstered seat.
Figure 5:
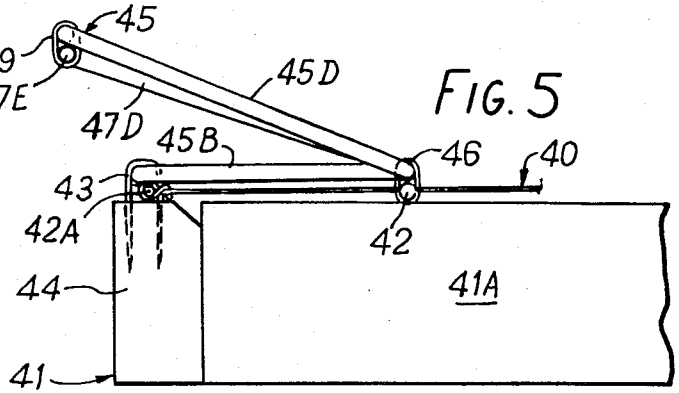
FIG. 5 is a side view corresponding to FIG. 4.

Referring now to FIGS. 4 and 5, which relate to a domestic seat, a pad 40 similar in all respects to pad 13 is suspended over a wooden base frame 41. In this case, cords 42 of the pad extend transversely between side lengths 41A of the base frame, and the foremost cord 42A is secured by means of staples 43 to front length 44 of the base frame. The rearmost of the cords 42 (not shown) may be stapled or secured by springs to the rear length of the base frame 41.

In this embodiment, a front edge frame 45 formed of paper-covered wire similar to the cords 42 extends above and in front of the front length 44 of the base frame. Ends 45A of the frame 45 are secured by staples 43 to the frame length 44 and the edge frame comprises lengths 45B, short parts 45C, upwardly-extending lengths 45D, and a front length 45E. The parts 45C are clamped to cord 42 by means of clips 46, and act as torsion springs, the wire core of the edge frame being of sufficient resilience to produce an inherent spring effect. The front length 45E of the edge frame is supported by four spring elements 47 which are of the general form of so-called jack springs. The elements 47 are secured at their ends 47A to the frame length 44 by means of staples 43 and each comprises a length 47B, a torsion part 47C secured by clips 48 to cord 42, and a forwardly extending limb 47D. Ends 47 of the limbs are secured to the edge frame 45 by means of clips 49.

In the construction shown in FIGS. 4 and 5, the operation of the spring elements 47 is essentially the same as that of the spring elements 18 of FIGS. 1 to 3, in that the edge frame is supported by means of elements having parts 47C which operate in torsion and limbs 47D which act as cantilever springs. In FIGS. 4 and 5 the lengths 47B are anchored on the base frame, whereas, in FIGS. 1 to 3, the central lengths of the spring elements 18 are effectively anchored on the pad 13.

Figure 6:
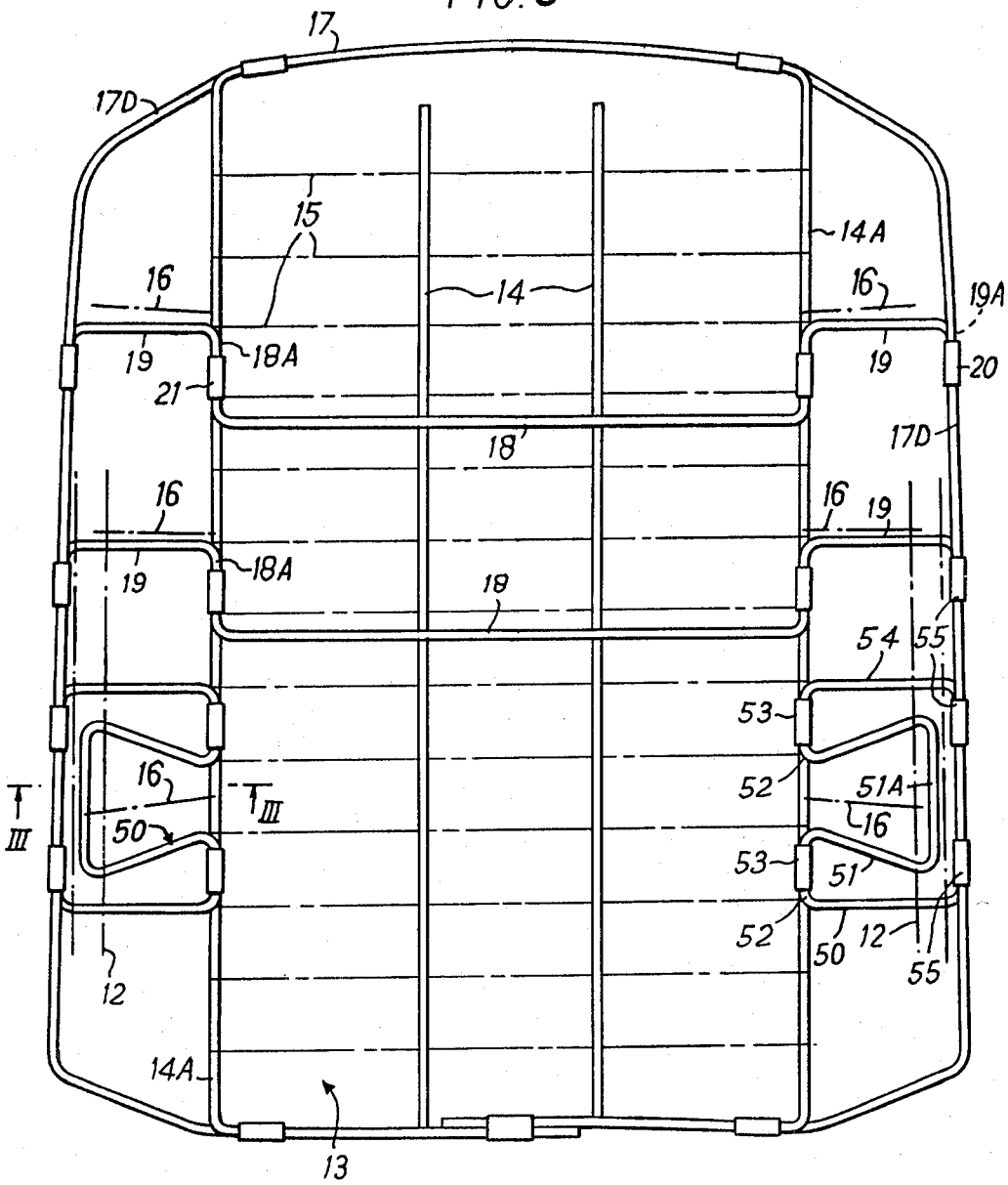
FIG. 6 is a plan view showing part of another form of vehicle seat frame according to the present invention.
Figure 7:
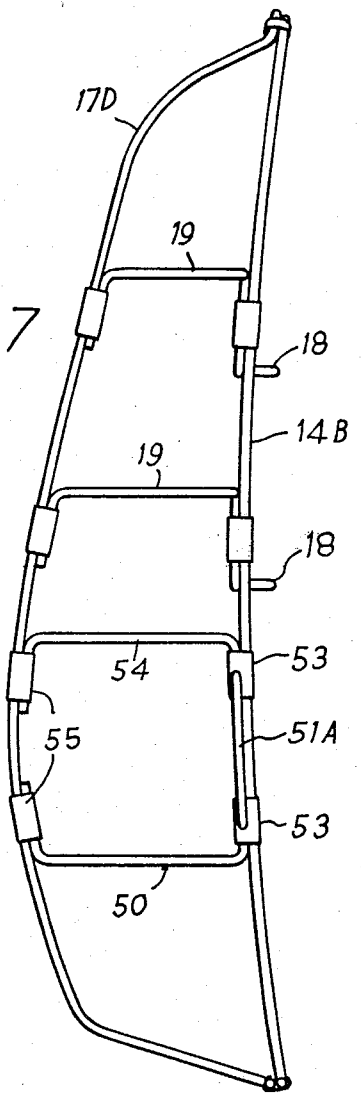
FIG. 7 is a side view corresponding to FIG. 6.

Referring now to FIGS. 6 and 7, which illustrate a frame for the back-rest or squab of a vehicle seat, the structure is similar to that shown in FIGS. 1 to 3, and the same reference numbers denote corresponding parts.

In the embodiment of FIGS. 6 and 7, it will be understood that a pad 13 is again suspended on springs 16 which are anchored in generally upright side lengths 12 of the frame base, as in FIG. 1. Two spring elements 18 having upwardly-extending side limbs 19 extend across the pad to carry top edge frame 17, and additional spring elements 50 also support the edge frame 17. Each of the elements 50 comprises a shaped centre part 51, a pair of torsion parts 52 secured by clips 53 to cord 14B, and a pair of upwardly-extending limbs 54 secured at their ends by clips 55 to side lengths 17D of the edge frame 17. In use, lengths 51A of the parts 51 are anchored on, or at least rest on, the side lengths 12 of the base frame 11, which are usually rearwardly raked, and thus give a calculated degree of lumber support at the lower end of the seat squab; the numbers and positions of the spring elements 18 and 50 can, of course, be varied according to the pattern of resilience required. As apparent from FIG. 6, when lengths 51A are not anchored to side lengths 12 of the base frame 11 they are free to slide transversely with respect to the seat frame, to allow extension of tension springs 16.

Figure 8:
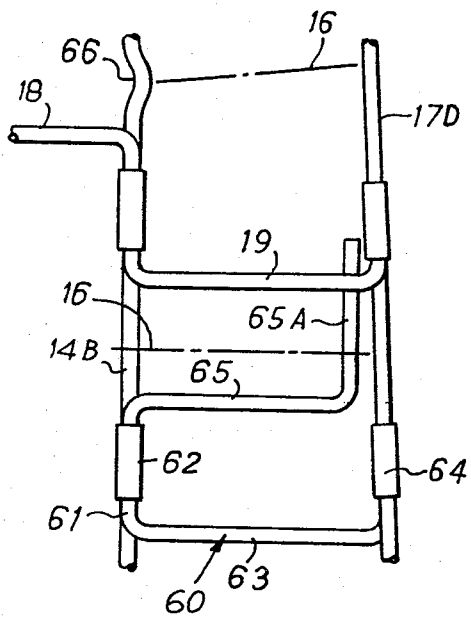
FIG. 8 is a detail plan view showing a modification of the frame shown in FIG. 6.

In FIG. 8 which shows a modification of the embodiment described with reference to FIGS. 6 and 7, the element 50 is replaced by a spring element 60. Each element 60 comprises a torsion part 61 secured by a clip 62 to the cord 14B, an upwardly-extending limb 63 secured at its end by clip 64 to side length 17A, and reaction limb 65. In use, length 65A of the limb 65 rests on the side length 12 of the seat frame, and the limb 65 may extend more or less parallel to the pad 14 or may be angled rearwardly to be supported on an alternative part of the seat structure. In this modification, the wire-cored cords 14B are formed with bowed parts 66 which act to maintain the correct positions of the tension springs 16.

I claim:

1. A seat frame comprising:

(a) a base frame;

(b) a non-extendible cushion support including logitudinally extending side wire portions and a plurality of spaced transversely extending cross wires anchored between said side wire portions;

(c) a plurality of tension spring means anchored between said side wire portions and said base frame to suspend said cushion support in tension transversely with respect to said base frame;

(d) a plurality of spaced spring wires each comprising a central portion extending transversely between said side wire portions, intermediate torsional portions extending parallel with and anchored to said side wire portions, and end portions extending transversely and outwardly from said torsional portions in an upward direction from and at an obtuse angle to said cushion support;

(e) an edge frame arranged above said cushion support and including resilient edge wire portions interconnecting the free ends of said end portions of the said spring wires at respective sides of the seat; and (f) a plurality of supplementary spring wires each comprising an intermediate torsional portion extending parallel with and anchored to a respective one of said side wire portions, a first limb extending from said torsional portion and anchored to a respective edge wire portion and a second limb transversely outwards from said torsional portion and having a free end, unconnected with said base frame, said end adapted to define a bearing portion for engagement with said base frame and located for transmission of reaction force to said base frame upon application of a load to the respective edge wire portion, whereby said free ends can move relative to said base frame upon extension of said plurality of tension spring means.

2. A seat frame as recited in claim 1, wherein each said supplementary spring wire comprises two said intermediate torsional portions, two said first limbs extending from the respective torsional portions to the edge wire portion, and an intermediate loop interconnecting said torsional portions and forming the said second limb, an extremity of said loop forming said bearing portion for engagement with the base frame.

3. A seat frame comprising:

(a) a base frame;

(b) a non-extendible cushion support including longitudinally extending side members and a plurality of transversely extending cross members anchored between said side members;

(c) a plurality of tension spring means anchored between said side members and said base frame to suspend said cushion support in tension transversely with respect to said base frame;

(d) an edge frame located above said cushion support and including longitudinally extending side edge wire portions spaced laterally outwards with respect to said side members of the cushion support;

(e) a first plurality of spring members anchored with respect to said cushion support and comprising spring limbs extending from said side members of the cushion support and anchored at their ends to the respective side edge wire portions of the edge frame in order to support the latter resiliently with respect to said cushion support; and (f) a second plurality of spring members each comprising an intermediate torsional portion extending parallel with and anchored to a side member of said cushion support, a first limb extending from said torsional portion and anchored to a respective side edge wire portion of said edge frame and a second limb extending transversely outwards from said torsional portion and having a free end, unconnected with said base frame, said end adapted to define a bearing portion for engagement with said base frame and located for transmission of reaction force to said base frame upon application of a load to the respective edge wire portion, whereby said free ends can move relative to said base frame upon extension of said plurality of tension spring means.

4. A seat frame as recited in claim 3, wherein each of said second plurality of spring members comprises two of said intermediate torsional portions, two of said first limbs extending from the respective torsional portions to the edge frame, and an intermediate loop interconnecting said torsional portions and forming the said second limb, an extremity of said loop forming said bearing portion for engagement with the base frame.

* * * * *